United States Patent [19]

Barker

[11] 4,398,533

[45] Aug. 16, 1983

[54] DRINKING DEVICE FOR DIVERS

[76] Inventor: Randall R. Barker, 6200 Carswell Access Rd. - Lot No. 3, Fort Worth, Tex. 76114

[21] Appl. No.: 260,002

[22] Filed: May 4, 1981

[51] Int. Cl.[3] ..... A61M 15/00

[52] U.S. Cl. ..... 128/202.15

[58] Field of Search ..... 128/202.13, 225, 202.15, 128/252, 214 C, 403; 405/186; 9/400; 206/218; 229/7 S; 215/11 A, 1 A, 229; 426/115, 66; 441/136; 220/90.4; 222/105, 107, 175

[56] References Cited

U.S. PATENT DOCUMENTS

| | | | |
|---|---|---|---|
| 183,521 | 10/1876 | Weck . | |
| 1,242,752 | 10/1917 | Youngren . | |
| 2,992,118 | 7/1961 | Daline et al. | 99/171 |
| 3,067,425 | 12/1962 | Colley | 2/6 |
| 3,122,297 | 2/1964 | Sachs | 229/14 |
| 3,545,604 | 12/1970 | Gunther, Jr. | 206/47 |
| 3,704,803 | 12/1972 | Ponder | 215/11 A |
| 3,773,256 | 11/1973 | Wright | 239/1 |
| 3,799,914 | 3/1974 | Schmit | 426/85 |
| 4,139,130 | 2/1979 | Glusker | 222/175 |
| 4,248,223 | 2/1981 | Turner et al. | 128/214 C |

FOREIGN PATENT DOCUMENTS

| | | | |
|---|---|---|---|
| 526303 | 6/1921 | France | 128/202.15 |

*Primary Examiner*—Kyle L. Howell
*Assistant Examiner*—Christine A. Fukushima
*Attorney, Agent, or Firm*—James E. Bradley

[57] ABSTRACT

A drinking device for underwater divers enables divers to drink while engaged in diving to provide moisture in the mouth and lungs. The device includes a container with a chamber for holding liquid and a passage leading to the chamber. A valve opens and closes the passage. The container has a pressure compensator for equalizing pressure in the chamber with exterior hydrostatic pressure. In the method, liquid is placed in the chamber. The diver provides suction on the end of the tube to draw liquid past the valve, then closes the valve. This displaces air from the container for diving.

5 Claims, 3 Drawing Figures

33
31
29
49
25
23
21
19
47

DRINKING DEVICE FOR DIVERS

BACKGROUND OF THE INVENTION

This invention relates in general to underwater diving equipment, and in particular to a device for enabling divers to drink liquids while underwater.

In scuba diving, compressed air carried in portable tanks by the diver is employed for breathing. The compressed air is normally very dry to avoid corrosion of the tank and valves. Breathing the dry air dries out the diver's mouth and lungs. Also, if the diver is in salt water, the salt water will extract moisture from the diver's body, further dehydrating the diver.

In many cases, it is not feasible for the diver to drink the water that he is diving in. Either the water is salt water, or it may be contaminated.

Being underwater presents problems in bringing a drinking container filled with water while diving. If the container is rigid, the water within would remain at atmospheric pressure, much less than the surrounding atmosphere. The pressure differential would make access to liquid inside the container difficult. If the container is flexible, any air inside is compressed by the hydrostatic pressure. If the diver accidentally swallows compressed air, it will expand in the diver's stomach as the pressure reduces while ascending. This could cause injury to the diver.

SUMMARY OF THE INVENTION

In this invention, a method and a device are disclosed for enabling the diver to drink liquids from time to time as he is diving. The device includes a container with a chamber for holding liquid and a passage leading to the chamber. The container has pressure compensating means for equalizing pressure in the chamber with exterior hydrostatic pressure. In the preferred embodiment, this pressure compensating means is handled by using a container with flexible walls. The passage has a valve for selectively sealing the liquid within, and preferably a tube for insertion in the diver's mouth.

In the preferred method, before diving, the diver fills the container with liquid, then sucks on the end of the tube while the valve is open until liquid is drawn past the valve. Then the valve is closed, maintaining the container and tube free of air. While underwater, the liquid in the container will be of the same pressure as the hydrostatic pressure of the water. The diver drinks from the container by placing the tube in his mouth, then opening the valve to sip from the container.

DESCRIPTION OF THE PREFERRED EMBODIMENT

Figure 1:
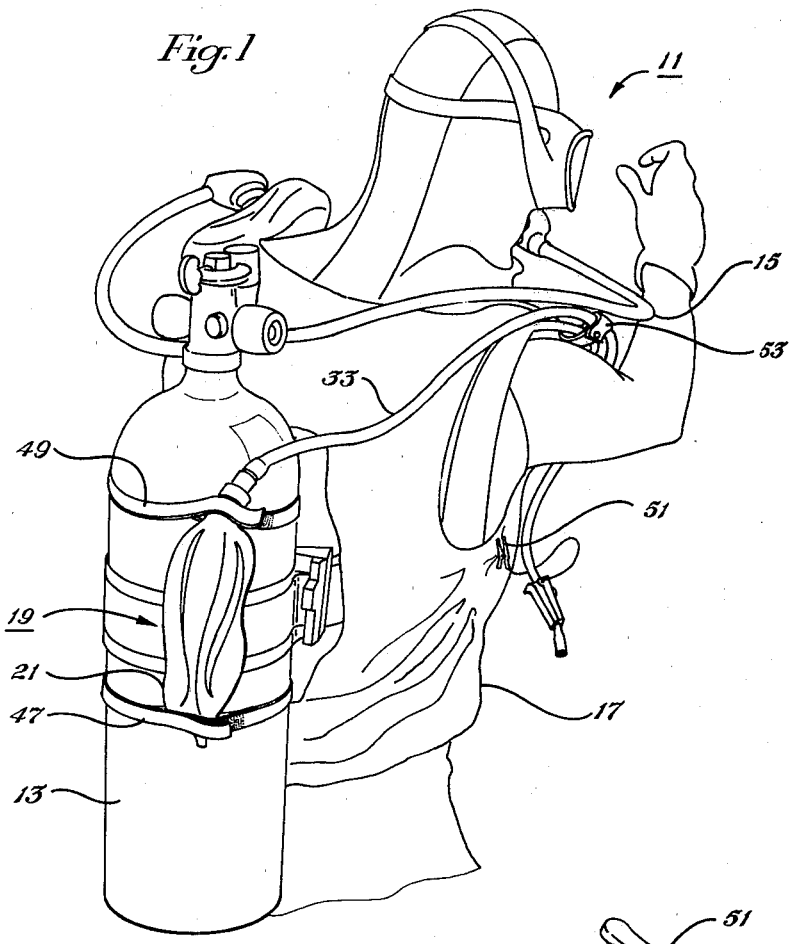
FIG. 1 is a perspective view illustrating a drinking device constructed in accordance with this invention.

Referring to FIG. 1, a diver 11 is shown wearing his diving equipment, which includes a tank 13 of compressed gas, normally air. A conduit 15 leads from tank 13 and has a mouthpiece for insertion in the diver's mouth to breathe from the tank. The diver may or may not be using a vest 17.

Figure 3:
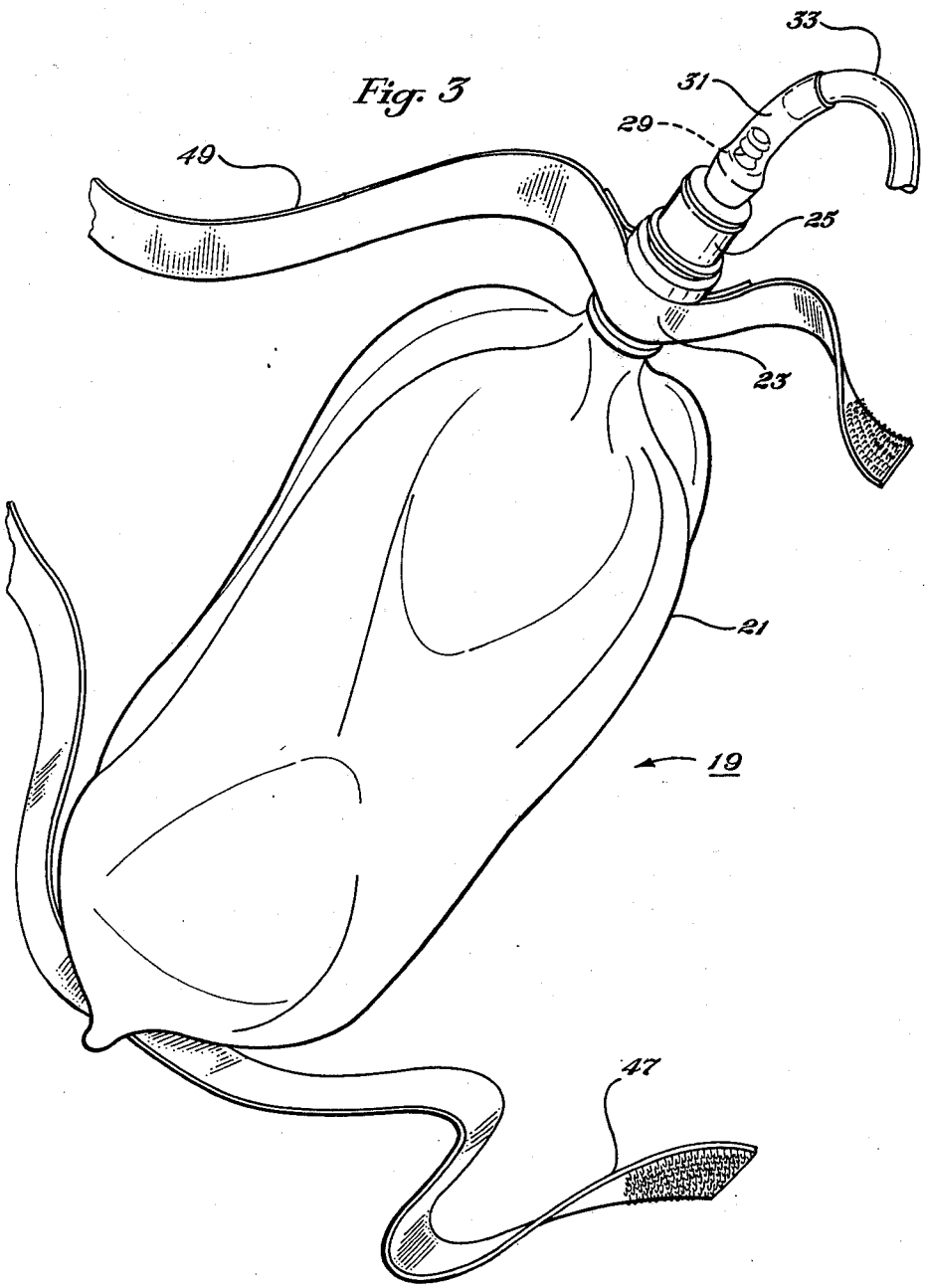
FIG. 3 is an enlarged perspective view of the container of the drinking device of FIG. 1.

A drinking device 19 is carried by tank 13. Referring to FIG. 3, drinking device 19 includes a container or bag 21. Bag 21 comprises a chamber with walls of flexible, elastomeric preferably clear material. Bag 21 has a single passage or mouth 23 to communicate with its interior. In the preferred embodiment, a cylindrical, tubular check valve 25 inserts into the mouth 23. Check valve 25 is a conventional one-way valve that prevents inward flow into bag 21, but allows flow out. Check valve 25 has a nipple 29 on its outer end.

Figure 2:
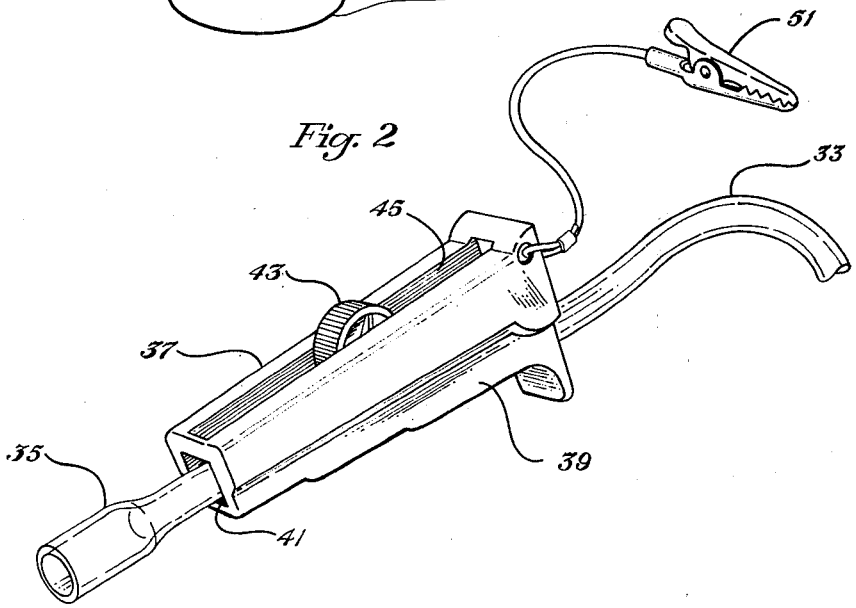
FIG. 2 is a perspective view of a valve for the device of FIG. 1.

An elastomeric sleeve 31 is adapted to fit tightly over nipple 29. The other end of sleeve 31 tightly and sealingly receives a tube 33. Referring to FIG. 2, the tube 33 has an open end with an enlarged diameter mouthpiece 35 formed on it. Tube 33 is elastomeric and preferably clear.

A valve 37 is located near mouthpiece 35 and serves as valve means for opening and closing the passage within tube 33. Valve means 37 is a conventional type for closing tubes. It includes a supporting member or housing 39 that has a passage 41 extending through it. Tube 33 extends through passage 41. A pinching member or wheel 43 is carried by housing 39. Wheel 43 is movable lengthwise along a track 45, and is retained in track 45 by an axle (not shown). Passage 41 inclines within housing 39 with respect to track 45. Moving wheel 43 to the right, as shown in FIG. 2, enlarges the effective diameter of passage 41. Moving wheel 43 to the left, or toward mouthpiece 35, causes wheel 43 to contact tube 33 and squeeze the wall of tube 33 into pinching contact to cut off fluid flow in tube 33.

A pair of straps 47 and 49 are secured to bag 21 near its bottom and top, respectively. Each strap 47, 49 has ends with material such as "Velcro" that adheres together when pressed into contact. The ends can be released from each other by pulling apart. Referring to FIG. 1, a strap 51 with a clip on its end is secured to tube 33 near valve 37. A strap 53 may be used to secure tube 33 to a shoulder strap for tank 13.

In operation, prior to diving, the diver removes check valve 25 from mouth 23 and fills the bag 21 with liquid, normally potable water. Check valve 25, with tube 33 connected to it, is placed into mouth 23. The diver then places mouthpiece 35 into his mouth and sucks while bag 21 is below mouthpiece 35 and valve 37 is in the open position. Once the liquid flows past valve 37, valve 37 is closed prior to removing mouthpiece 35 from the diver's mouth. The transparency of bag 21 and tube 33 assures that no air pockets remain.

The diver then secures the device to his equipment by strapping bag 21 to air tank 13 with straps 47 and 49. The open end of tube 33 is secured to vest 17 by clip 51. As he descends underwater, hydrostatic pressure will act on the flexible walls of bag 21 to serve as pressure compensator means to equalize the pressure of the liquid inside with the hydrostatic water pressure. To drink, the diver removes his breathing regulator from his mouth and places the mouthpiece 35 close to his mouth and facing downwardly with valve 37 closed. He then blows into the mouthpiece to clear it of water and create an air bubble. He then opens valve 37 and sucks on the tube 33 to drink. When completed, he closes valve 37 and secures tube 33 with strap 51. Check valve 25 prevents liquid from flowing into bag 21.

The invention has significant advantages. The device and method provides liquid during diving for drinking. The liquid will be at hydrostatic pressure and substantially free of compressed air, which will allow it to operate at any depth without internal pressure adjustment. It is simple and inexpensive.

While the invention has been shown in only one of its forms, it should be apparent to those skilled in the art that it is not so limited but is susceptible to various changes and modifications without departing from the spirit of the invention.

I claim:

1. A method of providing liquid for drinking while engaged in underwater diving, comprising:

providing a container with a chamber for holding liquid, a passage leading to the chamber with a mouthpiece at an entrance to the passage, and valve means located near the entrance for opening and closing the passage to the chamber;

providing the container with pressure compensator means for equalizing pressure in the chamber with exterior hydrostatic pressure;

placing a liquid into the chamber; then providing a lower pressure at the mouthpiece than in the chamber to draw liquid into the passage and past the valve means; then closing the valve means while maintaining the lower pressure and submerging with the container.

2. The method according to claim 1 wherein the step of providing the container with pressure compensating means comprises providing the chamber with flexible walls.

3. A method of providing liquid for drinking while engaged in underwater diving, comprising:

providing a flexible container with a mouth;

filling the container with liquid;

securing a first end of a tube to the mouth, the tube having a second end with a valve near the second end for opening and closing the tube; then opening the valve and sucking on the second end of the tube to draw liquid past the valve; then closing the valve while maintaining suction; and releasing the suction and submerging with the container.

4. The method according to claim 3, further comprising the step of placing check valve means in the device for allowing flow of liquid from the container but not into the container.

5. The method according to claim 3 further comprising the step of, prior to drinking while submerged, blowing into the second end of the tube and prior to opening the valve to free the tube between the second end and the valve of water from the environment.

* * * * *